United States Patent [19]

McGaw, Jr.

[11] 4,121,736

[45] Oct. 24, 1978

[54] HAND HELD ATOMIZER WASHING DEVICE

[76] Inventor: Wilbert Hersman McGaw, Jr., 2103 Murcia Ct., La Jolla, Calif. 92037

[21] Appl. No.: 716,652

[22] Filed: Aug. 23, 1976

[51] Int. Cl.[2] ..... B05B 7/32

[52] U.S. Cl. ..... 222/94; 222/95; 222/136; 222/144.5; 222/401; 239/373; 239/375; 137/630.2

[58] Field of Search ..... 222/136, 401, 144.5, 222/94, 95; 239/304, 415, 528, 373, 375; 137/630.2

[56] References Cited

U.S. PATENT DOCUMENTS

| | | | |
|---|---|---|---|
| 1,236,215 | 8/1917 | Schade | 222/401 X |
| 1,751,129 | 3/1930 | Cocks | 222/401 X |
| 2,635,010 | 4/1953 | Sanders et al. | 239/415 |
| 3,295,727 | 1/1967 | Kates et al. | 222/136 |
| 3,543,965 | 12/1970 | Lehmann | 222/144.5 X |
| 3,955,720 | 5/1976 | Malone | 222/401 X |

*Primary Examiner*—Stanley H. Tollberg
*Assistant Examiner*—Frederick R. Handren
*Attorney, Agent, or Firm*—Brown & Martin

[57] ABSTRACT

A hand held atomizer washing device comprises a housing having a large reservoir for containing water and a small flexible walled reservoir mounted inside the larger reservoir for containing a liquid detergent, a hand pump incorporated in the handle of the device for pressurizing the large chamber and simultaneously therewith pressurizing the smaller chamber, a pair of valves with a common actuator member controls communication of either the water or soap, or both, by way of a spray nozzle.

7 Claims, 6 Drawing Figures

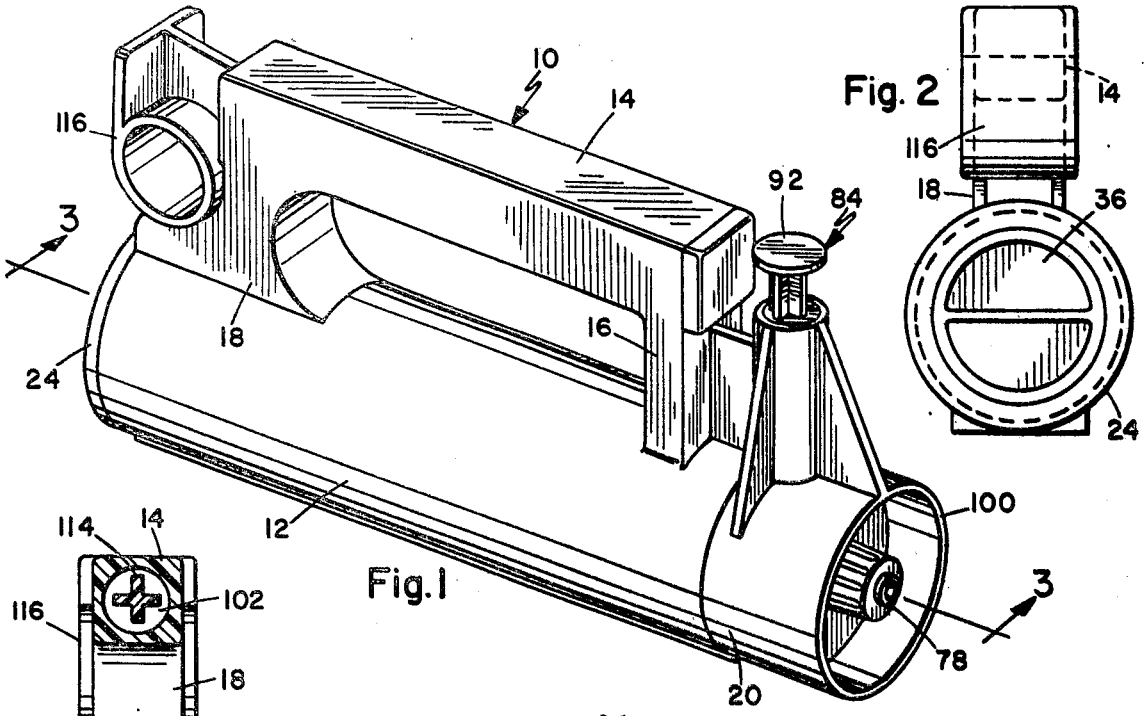
Fig. 1
Fig. 2
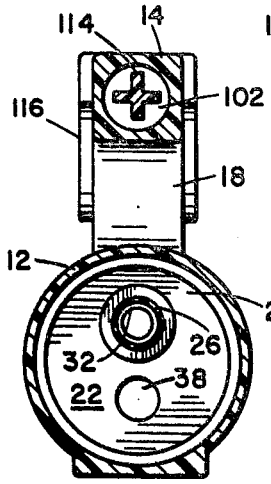
Fig. 4
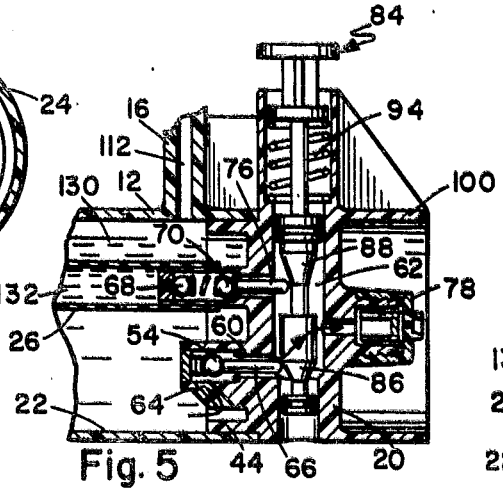
Fig. 5
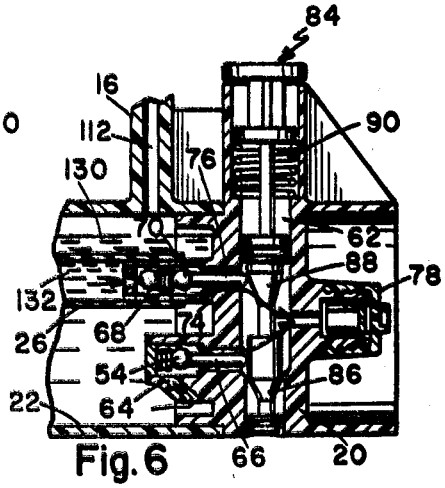
Fig. 6
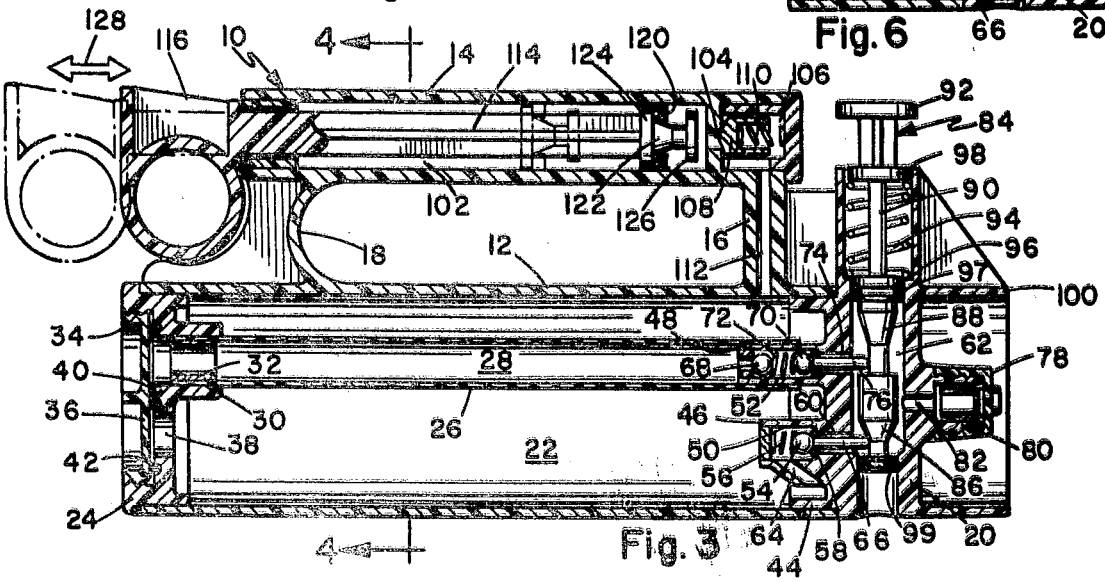
Fig. 3

HAND HELD ATOMIZER WASHING DEVICE

BACKGROUND OF THE INVENTION

The present invention relates to atomizers and pertains particularly to a hand held atomizer for dispensing multiple liquids.

In many situations, such as camping for example, normal bathing is not possible for several reasons. These include lack of an adequate supply of water, as well as for ecological reasons. While the so-called sponge bath is one solution to the problem, it is not satisfactory to many people.

SUMMARY AND OBJECTS OF THE INVENTION

It is the primary object of the present invention to overcome the above problem of the prior art.

Another object of the present invention is to provide a portable hand held atomizer that overcomes the above problems of the prior art.

A further object of the present invention is to provide a simple and inexpensive hand held atomizer that is capable of dispensing and atomizing a plurality of liquids, either individually or in combination.

In accordance with the primary aspect of the present invention, a hand held atomizer includes a housing defining a pair of separate chambers for containing separate and distinct liquids, with common means for pressurizing the chambers and a single control means for selectively dispensing the liquid, either individually or simultaneously by way of a nozzle.

BRIEF DESCRIPTION OF THE DRAWING

The above and other objects and advantages of the present invention will become apparent from the following description when read in conjunction with the accompanying drawings wherein:

FIG. 1 is a perspective view of the apparatus of the present invention.

FIG. 2 is a rear elevational view of the apparatus of FIG. 1.

FIG. 3 is a sectional view taken on line 3—3 of FIG. 1.

FIG. 4 is a sectional view taken on line 4—4 of FIG. 3.

FIG. 5 is a sectional view similar to a portion of FIG. 3 showing the valve in a water dispensing position.

FIG. 6 is a similar view showing the valve in a water additive mixing position.

DETAILED DESCRIPTION OF THE PREFERRED EMBODIMENT

Turning now to FIG. 1 of the drawing, there is illustrated, in perspective view, a hand held atomizer in accordance with the present invention and generally designated by the numeral 10. The apparatus comprises a generally cylindrical main housing 12 having a handle 14 for grasping by the hand, and connected to the housing by means of connecting members 16 and 18. A forward housing 20 is detachably secured to the main housing 12 and contains a dispensing nozzle, valve, and actuating mechanism to be described herein below. This forward housing is preferably formed to be detachably secured to the main housing 12 as shown.

The main housing 12 may be of any suitable configuration but, as illustrated, comprises a generally cylindrical configuration defined by walls similarly defining a cylindrical chamber 22 closed at its forward end by housing 20 and closed at the rear end by a suitable closure cap 24.

A flexible tubular member 26 is mounted within chamber 22 of the housing between cap member 24 and the forward housing 20 thereby defining a cylindrical chamber 28 within the chamber 22. The left or rear end of tubular member 26 is secured in a suitable manner into a bore 30 formed in cap member 24. This end of tubular member 26 extends within bore 30 and is secured in a suitable manner such as for example, by clamping between a sleeve member 32 and the inner wall of the bore 30. The bore 30 provides an opening by which the chamber 28 may be filled. This bore 30 communicates with an enlarged bore 34 formed in end cap 24 which includes threaded walls for receiving a removable closure member 36 threadably engaged therewith. Another opening or port 38 provides communication between bore 34 and the main chamber 22. Suitable seal means, such as annular seal members 40 and 42, provide sealing engagement with the inner surface of closure member 36 for sealing the two chambers 22 and 28. Thus, the closure member 36 becomes a common filler cap for simultaneously opening into chambers 22 and 28 to permit the chambers to be filled with a suitable liquid or the like.

The forward housing 20 includes an annular flange 44 extending into the bore of housing 12 and defining a seal or closure for the forward end of the chamber 22. The forward housing 20 includes a pair of projections 46 and 48 extending inward into the chamber 22 of housing 12. Both of these projections 46 and 48 include valve bores 50 and 52 for containing check valve means. The projection 48 is preferably of a cylindrical outer configuration for receiving the end of tubular member 26 in a sealing engaging fashion thereby sealing the chamber 28. The bore 50 defines a valve chamber in which is mounted a suitable check valve such as a ball 54 and spring 56. A suitable closure member encloses the spring and ball such that the spring 56 biases the ball 54 into engagement with suitable seat, such as an annular seal or O-ring 58. A passage 60 communicates the chamber 50 with a transverse bore 62 within the housing 20.

A passage 64 communicates the chamber 22 with the valve chamber 50 and thereby with passage 60 and transverse bore 62. The passage 64 extends downward to the bottom of the chamber 22 when the atomizing apparatus is in its upright position as shown in FIG. 3, for example. This permits liquid to be dispensed from this chamber when the level therein is very low. An actuating rod or member 66 is provided for actuating of the valve 54 for unseating same.

The chamber 28 is communicated with the transverse bore 62 by means of a dual check valve including a first ball 68 biased into engagement with a valve seat surrounded or defined by a bore defining the inlet to chamber 52 and a second valve member 70 biased into engagement with a seat surrounding a passageway 74 communicating with the transverse bore 62. A spring 72 is disposed between for biasing the respective valve ball members 68 and 70 into respective engagement with the respective seats. An actuating rod or plunger 76 is disposed in passage 74 for engagement with and unseating the valve member 70.

A suitable dispensing or atomizing nozzle of conventional design generally designated by the numeral 78 is secured to a forward projection 80 on forward housing 20 and communicates fluid from a passage 82 from the bore 62 to externally of the housing. The bore 62 essentially defines a mixing chamber when both valves 70 and 54 are open permitting fluid to flow from both chambers 22 and 28.

Suitable valve actuating means in the form of a plunger generally designated by the numeral 84 includes a pair of frusto conical shaped cam members 86 and 88 suitably spaced apart along the plunger 84 to provide the proper timing of actuation of valves 54 and 70. The plunger includes a stem 90 connected to a thumb or finger actuating a button 92 to permit depression of the plunger by the finger for actuation of the one or the other, or both valves 54 and 70. A suitable spring such as a coil spring 94 engages shoulder 96 in bore 62 and a flange 98 on the plunger 84, for biasing the plunger upwardly to the non-actuated position. Suitable seal means such as a pair of spaced O-rings 97 and 99 suitably engage and seal the plunger within the bore 62 as illustrated. These O-rings are disposed on and remain on opposite sides of the passages 60 and 74. It will also be noted that bore 82 leading to the dispensing nozzle 78 is located between the two passageways 74 and 60. Suitable forwardly extending flange means 100 may be provided for extending forwardly around the protecting the dispensing nozzle 78 against damage. It will be noted that this flange 100 extends beyond the end of the nozzle 78.

Suitable pressurizing means in the form of a hand pump are provided for pressurizing the chambers 22 and 28. The hand pump comprises a cylindrical bore 102 formed in the handle 14 and communicating at its forward end by means of a port or opening 104 with a valve chamber 106 in which is disposed a check valve member 108 biased by spring means 110 to the closed position. The valve chamber and the port 104 communicates by means of a passage 112 with the chamber 22. A plunger 114 having a suitable handle 116 at its rear end, includes a suitable sealing means at its forward end.

The sealing means comprises an annular forwardly directed lip seal member 120, which is cammed outward by means of a frusto conical surface 122 into engagement with the walls of the bore 102 when the plunger is pushed in the forward direction with annular shoulder 124 engaging the seal for pushing it forward. When the plunger is pulled to the rear, annular seal 120 rides downward off of cam surface 122 and is pulled to the rear by means of a flange 126.

In operation, the apparatus is especially designed for use as a portable washing device such that the chamber 22 is loaded with water 130 and the chamber 28 with a suitable liquid soap 132, or the like. When it is desired to use the device, the chamber 22 is pressurized by means of the hand pump simply by stroking the pump back and forth as shown by the arrow 128. Air is trapped forward of the seal 120 and is forced past valve 108 into the chamber 22. As pressure goes up within chamber 22, the pressure acts on the flexible walls 26 of chamber 28 also applying a pressure thereto. With the valve actuator 84 in the position as shown in FIG. 3, both valves 54 and 70 are in a closed position closing the chambers and preventing the communication of any fluid to the nozzle 78. When the valve actuator 84 is depressed part way as shown in FIG. 5, the valve 54 to the large chamber 22 is open and fluid flows, as shown by the arrow in FIG. 5, through the valve chamber 56 and passage 60, across the plunger by way of bore 62, through the passageway 82 and out the nozzle 78. With the valve actuator in this position as shown in FIG. 5, only the lower valve is open permitting the flow of fluid from the chamber 22. The valve 70 remains closed so that no fluid flows from the chamber 28.

Upon further depression of the valve actuator 84 to the position such as shown in FIG. 6, both chambers 22 and 28 become open to the communication of fluid by way of the valves 54 and 70, bore 62, and passage 82, to exit through the nozzle 78.

With this arrangement, fluid may be selectively dispensed from the chamber 22 or from both chambers simultaneously. It will be appreciated that although the present invention is designed for specific use, with the use of water and a soap or the like contemplated, the apparatus may be used for other purposes. For example, anytime it is desirable to have the availability of selecting a single liquid or a mixture of two liquids, it will be also appreciated that the cams on plunger 84 may be modified to vary the timing of the discharge of liquid from the respective chambers 22 and 28. Accordingly, they may be so constructed that either chamber may be selected first or alternately prior to selection of both chambers.

To release pressure from chamber 22 after use, the device is held with nozzle 78 upward, so that the passage 64 is above the liquid level. Plunger 84 is then partially depressed to open only the valve 54, allowing the compressed air to escape.

While the present invention has been illustrated and described by means of a single embodiment, it is to be understood that numerous changes and modifications may be made therein without departing from the spirit and scope of the invention as defined in the appended claims.

Having described my invention, I now claim:

1. A hand held multi-liquid atomizing dispenser, said dispenser comprising in combination, a housing, an atomizing nozzle on said housing, a first liquid reservoir for containing a first liquid defined by said housing, a second liquid reservoir defined by said housing for containing a second liquid, means for pressurizing both of said reservoirs, valve means for selectively communicating one of said reservoirs with said atomizing nozzle and for selectively communicating both of said reservoirs with said nozzle, said first reservoir comprising a fluid tight container, said second reservoir comprising a flexible container disposed in said fluid tight container, said housing includes a handle, said means for pressurizing said reservoir includes a manual pump mounted in said handle and communicating with said first reservoir, a bore extending transverse to the axis of said fluid tight container, a first passageway communicating said first reservoir with said bore, a second passageway communicating said second reservoir with said bore, a first valve member disposed in said first bore, a second valve member disposed in said second bore, and actuating means reciprocably mounted in said bore for actuating said first and said second valve members for controlling communicating of liquid via said bore to said atomizing nozzle.

2. The liquid atomizing dispenser of claim 1 wherein:

said actuating means comprises a plunger in said bore,
first and second cam means spaced axially along said plunger,
a first pin in said first passageway for engagement by said first cam means for actuating said first valve member,
a second pin in said second passageway for engagement by said second pin for actuating said second valve member.

3. The liquid atomizing dispenser of claim 2 wherein:
said first and said second valve members are check valve members normally biased to a closed position.

4. A hand held multi-liquid atomizing dispenser, said dispenser comprising in combination:
a housing,
an atomizing nozzle on said housing,
a first liquid reservoir for containing a first liquid defined by said housing,
a second liquid reservoir defined by said housing for containing a second liquid,
means for pressurizing both of said reservoirs,
valve means for selectively communicating one of said reservoirs with said atomizing nozzle and for selectively communicating both of said reservoirs with said nozzle,
a bore extending transverse to the first liquid reservoir,
a first passageway communicating said first reservoir with said bore,
a second passageway communicating said second reservoir with said bore,
a first valve member disposed in said bore,
a second valve member disposed in said second bore,
actuating means reciprocably mounted in said bore for actuating said first and said second valve members for controlling communicating of liquid via said bore to said atomizing nozzle,
said housing includes a handle, and
said means for pressurizing said reservoir comprises a manual pump mounted in said housing.

5. A hand held multi-liquid atomizing dispenser, said dispenser comprising in combination:
a housing,
an atomizing nozzle on said housing,
a first liquid reservoir for containing a first liquid defined by said housing,
a second liquid reservoir defined by said housing for containing a second liquid,
means for pressurizing both of said reservoirs,
valve means for selectively communicating one of said reservoirs with said atomizing nozzle and for selectively communicating both of said reservoirs with said nozzle,
a bore extending transverse to the first liquid reservoir,
a first passageway communicating said first reservoir with said bore,
a second passageway communicating said second reservoir with said bore,
a first valve member disposed in said bore,
a second valve member disposed in said second bore,
actuating means reciprocably mounted in said bore for actuating said first and said second valve members for controlling communicating of liquid via said bore to said atomizing nozzle,
said first reservoir comprising a fluid tight container,
said second reservoir comprising a flexible container disposed in said fluid tight container,
said housing includes a handle, and
said means for pressurizing said reservoir includes a manual pump mounted in said handle and communicating with said first reservoir.

6. The liquid atomizing dispenser of claim 5 wherein:
said housing includes a forward end and a rearward end,
said atomizing nozzle is at said forward end, and
said valve means is disposed at said forward end between said cylindrical housing means and said nozzle.

7. A hand held multi-liquid atomizing dispenser, said dispenser comprising in combination:
a housing,
an atomizing nozzle on said housing,
a first liquid reservoir for containing a first liquid defined by said housing,
a second liquid reservoir defined by said housing for containing a second liquid,
means for pressurizing both of said reservoirs,
valve means for selectively communicating one of said reservoirs with said atomizing nozzle and for selectively communicating both of said reservoirs with said nozzle,
a bore extending transverse to the first liquid reservoir,
a first passageway communicating said first reservoir with said bore,
a second passageway communicating said second reservoir with said bore,
a first valve member disposed in said bore,
a second valve member disposed in said second bore,
actuating means reciprocably mounted in said bore for actuating said first and said second valve members for controlling communicating of liquid via said bore to said atomizing nozzle,
said first liquid reservoir comprising a tubular member to which said bore extends transversely,
a plug member for fitting into the tubular member at the opposite end of said tubular member from said atomizing nozzle,
said plug member having a cylindrical recess therein,
said second liquid reservoir comprising a tubular flexible member, with one end fitting into said recess and the other end connecting to said second passageway,
and said plug member having means for access to said first and second reservoirs for selectively filling said reservoirs with a desired fluid.

* * * * *